United States Patent [19]

Musz et al.

[11] 4,134,242

[45] Jan. 16, 1979

[54] METHOD OF PROVIDING THERMAL INSULATION AND PRODUCT THEREFOR

[75] Inventors: Andrew Musz; John A. Hoehler, both of Littleton; Susan F. Hilt; William H. Kielmeyer, both of Englewood, all of Colo.

[73] Assignee: Johns-Manville Corporation, Denver, Colo.

[21] Appl. No.: 829,693

[22] Filed: Sep. 1, 1977

[51] Int. Cl.[2] ..... E04B 1/76; F16L 59/00

[52] U.S. Cl. ..... 52/309.1; 52/404; 52/743; 252/62

[58] Field of Search ..... 52/743, 404, 309.1; 106/DIG. 2; 252/62

[56] References Cited

U.S. PATENT DOCUMENTS

| | | | |
|---|---|---|---|
| 2,235,542 | 3/1941 | Wenzel | 52/743 X |
| 3,042,578 | 7/1962 | Denning | 106/DIG. 2 |
| 3,118,194 | 1/1964 | Biais | 52/743 |
| 3,176,354 | 4/1965 | Blau et al. | 52/743 |
| 3,447,789 | 6/1969 | Sharp | 209/10 X |
| 3,598,672 | 8/1971 | Heller | 52/404 X |

*Primary Examiner*—Alfred C. Perham

*Attorney, Agent, or Firm*—Robert M. Krone; Joseph J. Kelly; Charles C. Corbin

[57] ABSTRACT

A free flowing thermal insulation which may be installed by auger feeding, blowing or pouring is disclosed. Granular material having a requisite K value (e.g., 0.20–0.315 BTU-in/°F-ft$^2$-hr) is a major component of the insulation and is thoroughly mixed with a minor component of fibrous thermal insulating material to form a mixture which is used to provide the thermal insulation. Also included in the thermal insulation is a dust suppressant in quantities as required.

31 Claims, 7 Drawing Figures

THERMAL CONDUCTIVITY

METHOD OF PROVIDING THERMAL INSULATION AND PRODUCT THEREFOR

BACKGROUND OF THE INVENTION

The present invention relates to a dry, free flowing thermal insulation particularly suitable for installation in building sidewall cavities and attics. More specifically, the present invention relates to a thermal insulation including a major amount of granular thermal insulating material and a minor amount of fibrous thermal insulating material. This thermal insulation may conveniently be installed by auger feeding, blowing or pouring the thermal insulation into place.

Heretofore it was known to insulate building sidewall cavities and attics with many types of thermal insulating materials. Preformed insulation, e.g., fiber glass batts, is one conventional type of insulation used in such sidewall cavities and attics. The fiber glass batts are sized to fit between upright studs in a wall cavity or horizontal joists in an attic. While such fiber glass batts provide good insulation properties, e.g., an R value (in hr-ft$^2$-°F/BTU) of about 11 or 12, installation of such fiber glass batts can be very difficult after construction of a building is completed, particularly for the sidewall cavities which are typically inaccessible after completion of the building. In older buildings it is increasingly desirable to augment the amount of thermal insulation in the sidewall cavities and the attic but it is very difficult to utilize fiber glass batts unless there is adequate access to these spaces.

For many years, one method of insulating buildings has been to blow or pour a fibrous insulating material into cavities, e.g., sidewall cavities and attics, of such buildings. One known type of insulation utilized for reinsulating sidewall cavities and attics comprises ground cellulose fiber, e.g., ground newsprint, which is combined or impregnated with fire resistant additives. The cellulose fiber insulation is blown or poured into place through small access holes into a sidewall cavity or ceiling area. However, although the cellulose fibers are typically treated with fire resistant resistant material, the cellulose fibers still tend to burn. This feature is especially hazardous since in building sidewall cavities, insulated electrical wires may in time become worn thereby exposing the inner metal wires to the surrounding thermal insulation. If the thermal insulation surrounding such wires, i.e., the ground cellulose material, promotes combustion serious fires may result.

U.S. Pat. No. 2,235,542 discloses the use of asbestos with such materials so as to provide fire resistance. This patent states that the insulating material is preferably a dry, flakey or fibrous material so as to form insulating air cells. The patent also states that a granular material can be included if it is of a size so that it does not prevent the formation of the insulating air cells. Another known method for minimizing the possiblity of fire uses a thermal insulating material which is fire resistant such as mineral wool or glass fibers. One difficulty with such fibrous materials is that fibrous clumps or fragments tend to "hang up" on conduits and wires when the insulation material is used in a sidewall cavity.

One conventional insulation utilized for reinsulating or retrofitting insulation in sidewall cavities and ceiling areas is a synthetic foam which is typically blown into place. One disadvantage of such foams is that they may melt or burn and under these conditions poisonous gases are often released. Furthermore, such foams are subject to shrinkage and/or expansion after installation. If the foam shrinks sufficiently, gaps and channels in the insulation may result thereby providing free passage of air through the cavity or space to be insulated and seriously diminishing the thermal insulation value of the foam. Excessive expansion of the foam may result in sufficient stress on the confining sidewalls so as to cause the sidewall material to buckle or warp.

U.S. Pat. No. 3,447,789 relates to using expanded perlite as an insulating material. The use of granular material alone as an insulating material has the disadvantage that if an access hole is formed in a sidewall cavity being insulated the granular insulation tends to flow freely through the hole until the cavity above the access hole is emptied.

It is an object of the present invention to overcome the disadvantages of the prior art insulation materials by providing a dry, free flowing thermal insulation which has excellent thermal insulating properties and which readily fills a cavity but has sufficient integrity so as to have very minimal flow after it has been installed.

Other objects and advantages of the present invention will be apparent from the following description, the accompanying drawings, and the appended claims.

Accordingly, the present invention provides a free flowing thermal insulation including a major portion of granular material having low thermal conductivity and a minor portion of a fibrous thermal insulating material.

DETAILED DESCRIPTION OF PREFERRED EMBODIMENTS

Figure 1:
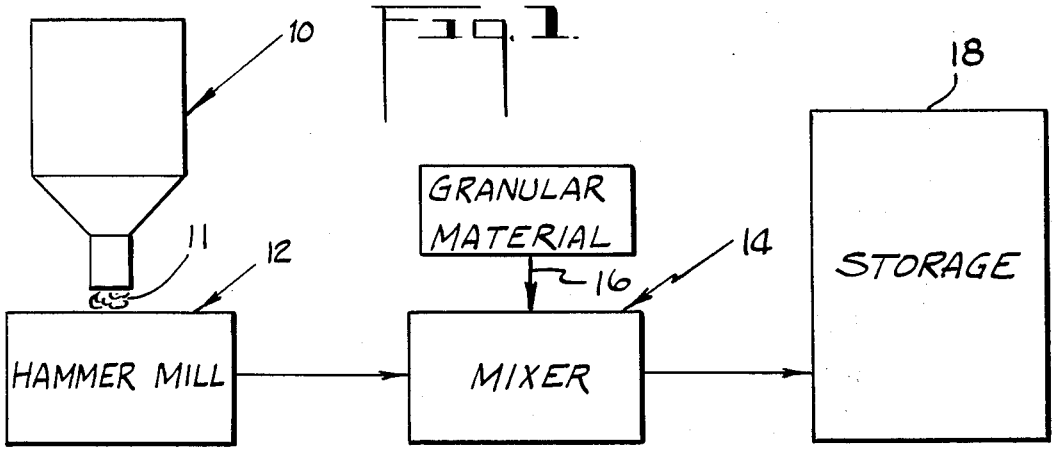
FIG. 1 is a schematic view illustrating a method of making a thermal insulation according to the present invention.
Figure 2:
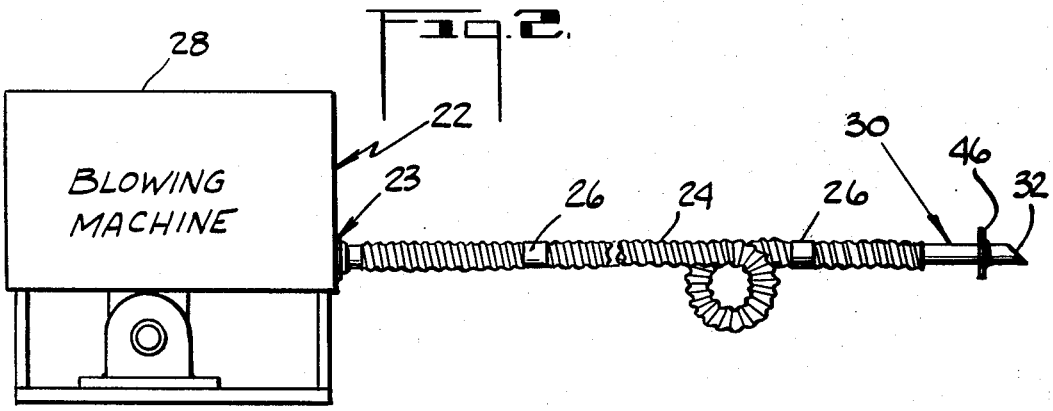
FIG. 2 is a partial schematic view illustrating an apparatus suitable for installing a thermal insulation according to the present invention.

The free flowing thermal insulation of the present invention includes a major portion of a granular material such as expanded perlite, vermiculite, pumice, silica or polystyrene. It should be noted that where fire resistance is required in addition to good thermal insulation properties, polystyrene granules should not be utilized. Of the fire resistant granular materials listed above (i.e., expanded perlite, vermiculite, pumice and silica), expanded perlite and vermiculite in particular have excellent thermal insulation properties, and are therefore especially suitable in the present invention. Combinations of the above granular materials may also be utilized.

The density of the granular material to be incorporated into the thermal insulation is selected to achieve a desirable thermal conductivity, e.g., a K value within the range of 0.2–0.315 BTU-in/°F-ft.$^2$-hr. In one embodiment of the present invention, perlite granules expanded to a loose density of 2.5 to 3 pounds per cubic foot are utilized. These expanded perlite granules have a K value of approximately 0.28 BTU-in/°F-ft$^2$-hr. Various grades of expanded perlite, for example perlite grades marketed by Johns-Manville Corporation under the trade designations PA116, PA115, and PA1-S-5, are excellent for use as the granular component of the insulation mixture. Typical range sieve analysis for these perlite grades are listed below in Table I:

TABLE I

| | % Retained Non Cumulative Range | | |
|---|---|---|---|
| U.S. Sieve No. | PA-1S5 | PA-115 | PA-116 |
| +30 | 10 max. | 2 max. | trace |
| −30 +50 | 30–45 | 4–12 | 4–12 |
| −50 +100 | 35–55 | 30–55 | 45–60 |
| −100 +200 | 4–15 | 25–45 | 25–40 |
| −200 | 6 max. | 20 max. | 10 max. |

The upper and lower limits for the amount of granular material, e.g., expanded perlite, utilized relative to the amount of fibrous material incorporated in the thermal insulation depends on several factors including economics and the amount of fibrous material required to prevent the granular material from readily pouring out from a cavity if a vertical portion of the surfaces defining the cavity is removed. When the thermal insulation of the present invention is used in a cavity, such as a sidewall of a dwelling, it is necessary to insure that the thermal insulation does not readily flow through any access hole formed in the sidewall. Thus, if it is necessary to reach any conduits or electrical wires contained in the sidewall cavity, the thermal stays in place rather than flowing freely through the access hole.

The minor portion of the thermal insulation preferably comprises glass fibers. When blowing wool type glass fiber is utilized as the fibrous material component of the thermal insulation it is desirable to minimize the amount of glass fibers since it is more expensive than perlite. However, for lower levels of glass fiber content, e.g., below approximately 5 wt% of the thermal insulation does not have sufficient integrity to prevent the thermal insulation from pouring out an access hole formed in the sidewall. However, with other fiber types or with different fiber diameters it may be possible to reduce the amount of fiber content down to approximately 1 wt% and still achieve the desire result of sufficient integrity of the thermal insulation to prevent free flow through any access hole in the supporting structure around the cavity. Thus, the upper limit for the granular material such as perlite is probably approximately 99 wt% with a lower limit of approximately 70 wt%. But preferably the upper limit for the granular material is within the range of 90 wt% to 95 wt%.

As noted above, glass fiber is a suitable fibrous material to be utilized in the thermal insulation mixture of the present invention. Other suitable fibrous materials include rock or slag wool, refractory fibers, and asbestos. Where fire resistance is not an essential feature of the insulation mixture, organic fibers such as cellulose may be incorporated. Various combinations of these fiber types may be interspersed with the granular material if desired. As with the granular material, the amount of fibrous material incorporated in the insulation mixture depends on several factors including economics (that is, relative cost of the fibrous material as compared to the granular material component of the thermal insulation) and the amount of a particular fibrous material necessary to get a desired integrity in the thermal insulation to prevent ready flow of the insulation when a portion of its support is removed. Furthermore, when the fiber content is too great relative to the amount of granular material there is a probability of the thermal insulation "hanging up" over conduits or channeling thereby resulting in undesirable void spaces in the insulation mass.

One suitable fibrous material for use in the thermal insulation of the present invention is a glass fiber blowing wool having a density of approximately 0.7 pounds per cubic foot with an installed K value of approximately 0.432 BUT-in/°F-ft$^2$-hr. This fibrous material is typically coated with approximately 3% to 12% of a phenolic resin binder which binder may also include urea extenders, lignin sulfonate, silane or various curing agents. The glass fibers typically have an average diameter of approximately 3.5 to 6.5 microns. The preferred form for the fiber glass is relatively small (e.g., 0.125–1.25" representative diameter) nodules or bundles of glass fibers. It is to be understood that the fibrous nodules are not generally of uniform shape, i.e., neither perfectly cubic or spherical. However, a cross-section of the nodule would typically have a dimension within the above stated range of 0.125 to 1.25". Thus, the representative diameter of the irregularly shaped nodule refers to its approximate cross-sectional dimension at any point. Glass fiber nodules having a representative diameter greater than approximately 1.25" are not suitable in sidewall applications since such large nodules tend to "hang up," i.e., form bridges over, any conduits or wires in the sidewall cavity. Such "bridges" result in uninsulated areas beneath the wires or conduits since the insulation cannot flow past the blocked area above the conduit or wire.

Other types and densities of glass fibers may be used which may or may not be coated with binder or other additives. The critical feature is that the glass fibers or other fibrous material provide sufficient integrity to the thermal insulation so that the insulation does not readily flow through an access hole in a sidewall. In one embodiment of the present invention cured glass fiber blowing wool hammer milled to a 1.5" size is utilized. This material may be stored in a suitable hopper 10. Prior to mixing the glass fibers or other fibrous material 11 with granular material such as expanded perlite, the glass fibers are remilled in a hammer mill 12 to form nodules having a representative diameter of approximately 0.25". It is important to note than when the fibrous material is added to the granular material, the fibers must be discrete nodules having a representative diameter within the range of 0.125" to 1.25". That is, it is essential that the fibers not be compacted or recompacted together to form larger bundles of fibers. To prevent such recompaction, after hammer milling the fibrous material to the desired nodule size, the fibrous material is typically transferred to a mixer 14 which is equipped with an impeller (not shown). Action of the impeller maintains the fibers in the desired separated nodule form until addition of the granular material as at 16. such as perlite, it is desirable to obtain even distribution of the fiber glass nodules throughout the perlite without breaking the perlite particles. One suitable mixer which achieves even dispersement of the granular material and the fibrous material without breaking the granular material utilizes plow shaped mixing tools which create a high rate of turbulance. One such mixer is marketed by Littleford Bros., Inc., Model No. FM-130. A tumbling mixer, such as that marketed by Patterson Kelley, Model No. P.K. No-211066, may also be used.

When expanded perlite particles having a loose density of approximately 2.5 to 3 pounds per cubic foot are dispersed with glass fiber nodules having a representative diameter of approximately 0.25" no settling of the components is noted during storage. Thus, after adequate mixing of the granular material and the fibrous material 11, the resulting thermal insulation can be transferred to suitable bulk storage as indicated generally by reference numeral 18 or into individual storage containers, e.g. kraft paper or plastic bags. However, it is necessary that any distribution means utilized to transfer the thermal insulation or used during installation of the thermal insulation provide equal flow rates for all components of the thermal insulation in order to prevent the components from separating from one another.

In addition to the granular material and the fibrous material components of the thermal insulation, dust suppressant may also be incorporated in an amount of approximately 0.5 wt% to 15 wt%, preferably 2.5 wt% to 10 wt% of the weight of the granular and fibrous components. Typically, the granular material and the fibrous material are interspersed in suitable percentages so as to comprise 100% of a composition. Dust suppressant is then added so that the total wt percentage of the mixture is greater than 100%.

Less dust suppressant is required to achieve adequate dust control when the dust suppressant is applied to the granular material-fibrous material mixture by spraying rather than by puring a liquid dust suppressant into the mixer 14 as the granular material and fibrous material are mixed together. Higher amounts of dust suppressant may be utilized for applications where the thermal insulation is poured or blown into an open space, e.g., an attic since in such applications inhalation of dust is more likely than in applications where the thermal insulation is blown into an enclosed area, e.g., a sidewall cavity. Suitable dust suppressants for use in the thermal insulation of the present invention include ethylene glycol, glycerine, or glycerol; water (with or without fungicides); sodium silicate; oil; lignin sulfonate; and polyethylene glycerine, or glycol. It should be noted that in applications where flame resistance is desirable, oil type dust suppressants should not be utilized.

In practice, tests were run on various thermal insulations made in accordance with the present invention. The fibrous material component was blowing wool glass fiber (marketed by Johns-Manville Corporation under the trade designation No. 1 Type Blowing Wool) which was hammer milled to form glass fiber nodules having a respresentative diameter of approximately 0.25". The hammer milled glass fibers were then transferred to a suitable mixer 14 such as those described above, so as to prevent recompaction of the glass fiber into large bundles or clumps of fibers. Expanded perlite having a loose density of 2.5 to 3 pounds per cubic foot, was then gently mixed with the glass fiber nodules so as to achieve uniform distribution of the glass fiber nodules throughout the perlite while avoiding breaking the expanded perlite granules. Dust suppressant in an amount of 5 to 10 wt% was then added to the mixed glass fiber nodules and expanded perlite and dispersed by the mixing action of the mixer 14.

The insulation can be stored in suitable containers, e.g., storage bags, until needed since the mixture does not tend to separate into its discrete components of glass fiber and perlite. Installation of the insulation composite can be achieved by pouring the thermal insulation into place or by blowing the thermal insulation into a cavity to be insulated, e.g., a sidewall cavity 20. For example, an electrically powered veridrive blowing machine 22 having a discharge outlet 23 and equipped with a smooth-bore flexible hose 24 connected together with external couplings 26 can be employed to discharge the thermal insulation from a storage hopper 28 of the blowing machine 22 into the cavities 20 to be insulated.

One blowing machine found to be suitable for the present invention is Model No. 5L-1103-E62-367 marketed by Wm. W. Meyer and Sons Inc., Skokie, Ill. This conventional blowing machine was equipped with an electric veridrive motor. The discharge outlet of the blowing machine had a diameter of approximately 3 inches whereas the flexible hose 24 employed had a diameter of approximately 2.5 inches.

To avoid any possible blocking which could result at the point where the discharge passageway narrowed from 3 inches to 2.5 inches, a rigid plastic extension (not shown) of the hose was inserted into the blowing machine at the discharge outlet 23. External couplings 26 on the flexible hose 24 were used to prevent blockage of flow of the thermal insulation at joints in the hose 24. Sections of the flexible hose are typically 50 feet in length and the examples recited herein utilized a hose having three such sections externally coupled together.

The flexible hose 24 is provided with a rigid discharge end 30 which is preferably angled at 45° as indicated at reference numeral 32.

Installation access holes 34 are provided through an inner wall structure 36 into the cavity 20. The sides of each cavity 20 are defined by a section of the inner wall structure 36, a section of an outer wall structure 38, and two sequential vertical studs 40. The vertical limits of the cavities 20 are defined by a ceiling structure 42 and a floor structure 44. Conduits 45 typically extend through the sidewall cavities 20.

The end 30 of the flexible hose 24 is inserted into one of the access holes 34. The access hole may be located in close proximity to the ceiling structure 42 or may be cut at other locations in the inner wall structure 36, such as at 34(*a*).

A sealing ring 46 is positioned around the end 30 of the flexible hose 24. The sealing ring 45 is situated so that it is in sealing engagement with the inner wall structure 36 during discharge of the insulation mixture through the hose 24 into the cavity 20.

Figure 3:
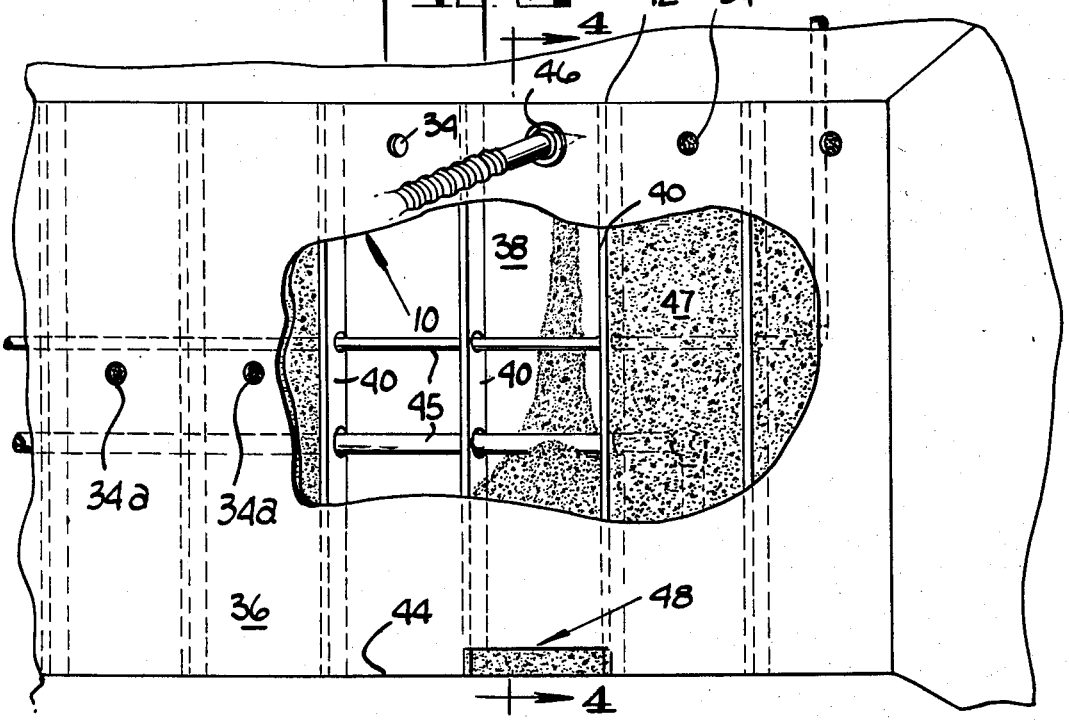
FIG. 3 is a sidewall structure partially broken away and illustrating a method of installing a thermal insulation according to the present invention.
Figure 4:
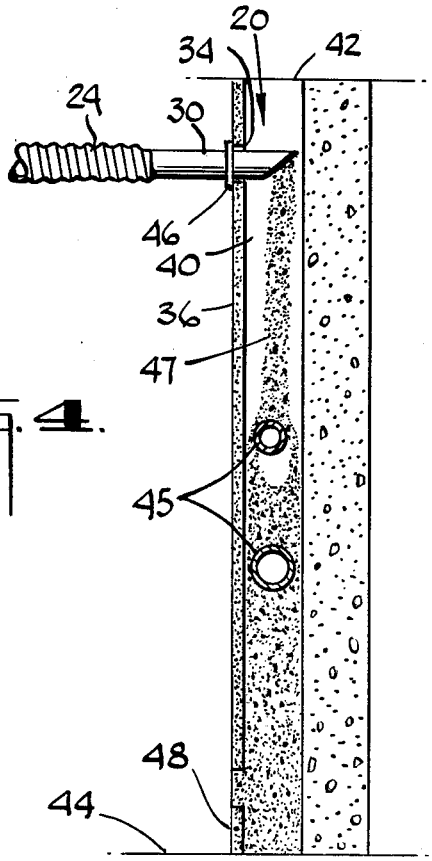
FIG. 4 is a cross-sectional view of the wall structure of FIG. 3 taken along line 4—4.

As shown in FIGS. 3 and 4, the end 30 of the hose 24 is inserted into the access hole 34 (or 34(*a*)). The blowing machine is then started and a thermal insulation 47 of the present invention is forced through the hose 24 and into the cavity 20 or other space to be insulated. Due to the unique properties of the thermal insulation of the present invention the mixture does not "hang up" on the conduits 45 but rather forms a uniform mass of insulation which fills the entire cavity 20. Even if a portion of the inner wall structure 36 is removed, for example a cut-out section 48 having a width of 14.5 inches and a height of approximately 6 inches, the insulation material 47 remains in place. Gouging of the insulation material 47 in the portion exposed by the removal of the section 48, while capable of removing that material actually scooped out, does not result in any surrounding material pouring out the cut-out section 48. The material remains in the cavity 20 in columnar form despite the presence of access holes 34 or 34(*a*) or cut-out section 48.

Figure 5:
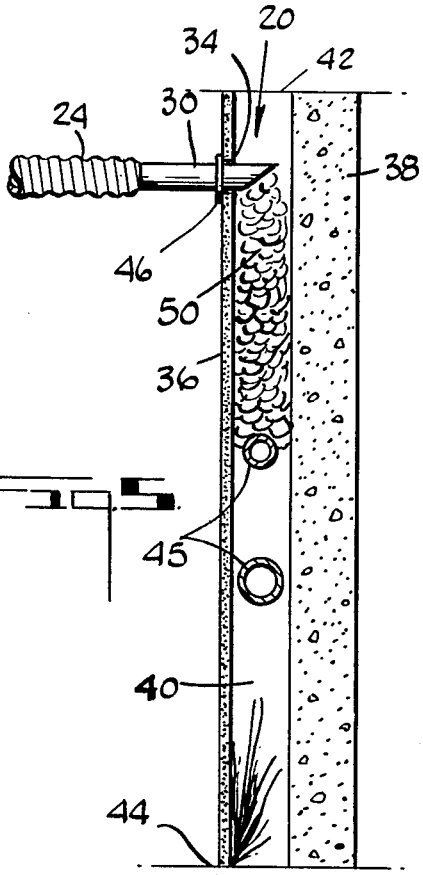
FIG. 5 is a sidewall structure in cross-section with its cavity being filled with only fibrous thermal insulating material
Figure 6:
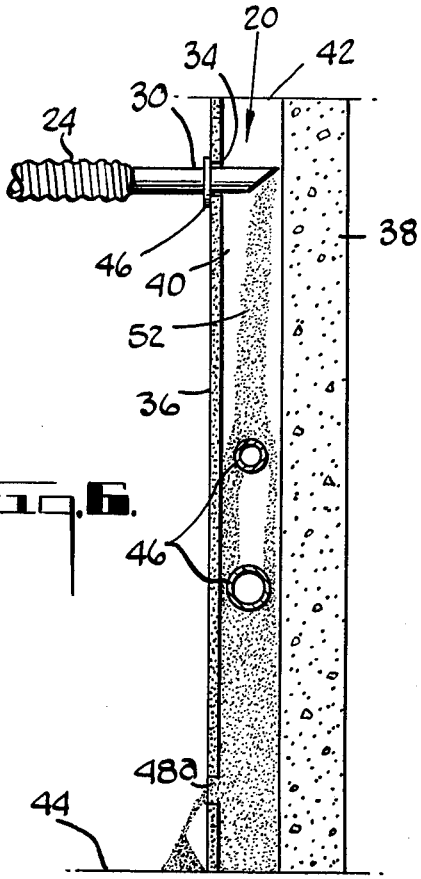
FIG. 6 is a sidewall structure in cross-section with its cavity being filled with a granular thermal insulating material.

FIGS. 5 and 6 illustrate comparative examples of other types of insulation material. More specifically FIG. 5 is a cross-sectional view of a wall structure similar to that shown in FIG. 4. However, in FIG. 5 a fibrous material 50 is blown into the cavity 20. Even when the fibrous material 50 is hammer milled to a nodule size suitable for use in the insulation mixture 47 of the present invention, (e.g., having a representative diameter of approximately 0.25 inch), use of the fibrous material 50 alone is unsuitable. The fibrous material 50 tends to recompact upon striking any obstruction, such as the conduits 45, and may then bridge across the obstruction preventing flow of the fibrous insulation to some portions of the cavity 20. In the event that the fibrous material 50 can be forced past any obstructions in the cavity 20, i.e., the conduits 45, the fibrous material still does not tend to form a uniform columnar mass but rather tends to have void spaces and channels which seriously affect the thermal efficiency of the system.

FIG. 6 illustrates the use of a granular material, e.g., an expanded perlite 52, as an insulation material for the sidewall cavity 20. Such granular insulation material does not have sufficient integrity to remain in columnar form in the event that a portion of its vertical support, e.g., a portion of the inner wall structure 36 is removed. If a section, such as indicated by reference numeral 48*a* is cutout, the expanded perlite 52 pours out the cut-out section 48*a*.

Tests were run incorporating 5, 10, 15, 20 and 30 wt% glass fibers having an average nodule size of approximately 0.25 inch. The balance of the mixture was expanded perlite having a density of 2.5 to 3 pounds. Approximately 5 and 10 wt% of ethylene glycol was added as dust suppressant. The components of the thermal insulation were mixed as described above and blown into sample sidewall cavities 7 feet high, 14.5 inches wide and 3.5 inches deep. After the thermal insulation was blown into place, a section 14.5 inches wide by 6 inches high of one confining sidewall was removed near the floor. It was observed that the various thermal insulations tested with 10 wt% to 30 wt% glass fibers content had excellent stability and integrity and did not flow through the opening formed in the retaining sidewall. In the example utilizing only 5 wt% glass, fibers, a minimal amount of flow of the thermal insulation occurred through the open section. The results of these tests are summarized in the following Table II:

TABLE II

| Expanded Perlite | Blowing Wool Fiber Glass (nodule rep. diameter = 0.25") | Ethylene Glycol (Dust Supp.) | Poured Density of Resulting Mixture | Blown Density (Installed Density)**** | K Value (BTU-in/° F-ft$^2$-hr) |
|---|---|---|---|---|---|
| 70% PA116* | 30% | 5% | 3.2 pcf | 3.47 pcf | .281 (estimated) |
| 85% PA116 | 15% | 5% | 3.15 pcf | 3.06 pcf | .275 (estimated) |
| 90% PA116 | 10% | 5% | 3.2 pcf | 3.03 pcf | .275 (estimated) |
| 95% PA1-S-5** | 5% | 5% | 2.95 pcf | 2.94 pcf | .273 (estimated) |
| 80% PA115*** | 20% | 5% | 4.65 pcf | | |
| 80% PA116 | 20% | 10% | 3.0 pcf | 3.2 pcf | .276 (actual) |
| 80% PA116 | 20% | 5% | 3.35 pcf | 3.5 pcf | .281 (estimated) |
| 80% PA1-S-5 | 20% | 10% | 3.45 pcf | 3.3 pcf | .279 (estimated) |

*PA116 - a grade of expanded perlite marketed by Johns-Manville having a poured density of 2.5 pcf and particle sizes within the ranges listed in Table I

**PA1-S-5 - a grade of expanded perlite marketed by Johns-Manville having a poured density of 2.5 pcf and particle sizes within the ranges listed in Table I

***PA115 - a grade of expanded perlite marketed by Johns-Manville having a poured density of 3.5–4.0 pcf and particle sizes within the ranges listed in Table I

**** - Installed Density = $\frac{\text{wt. of the thermal insulation removed from the cavity}}{\text{volume of the cavity}}$ A K value of 0.276 BTU-in/°F-ft$^2$hr was obtained for the test thermal insulation having a blown density of 3.2 pcf using a 36 inch heat meter according to the test procedures set forth in ASTM C-518. Since expanded perlite (the major component of the thermal insulations tested) has a straight line relationship when its density is plotted against the K value obtained for a given density (see FIG. 7), it is assumed that the thermal insulations of the present invention will have a similar straight line relationship.

Figure 7:
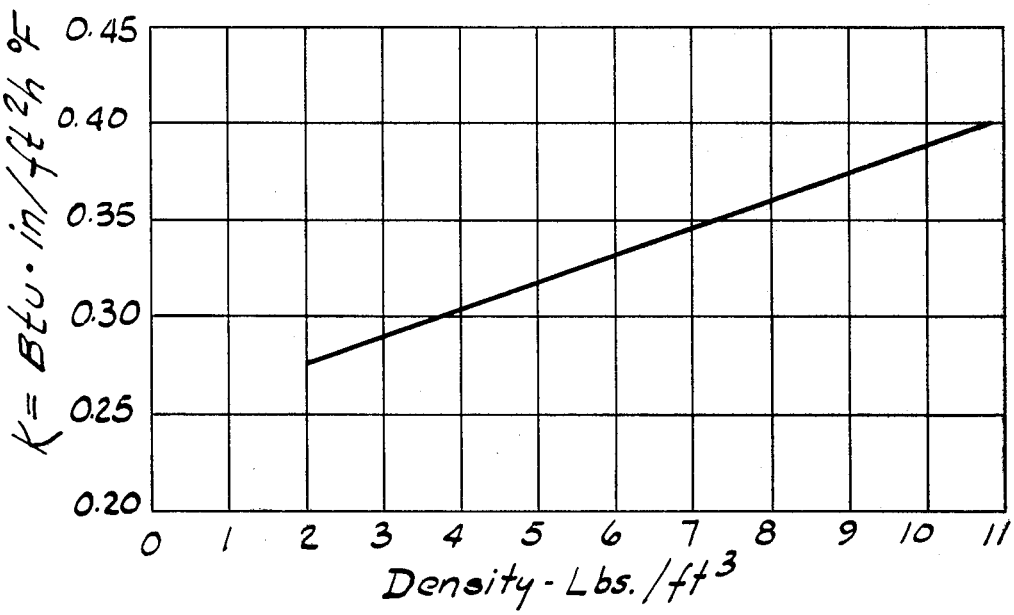
FIG. 7 is a graph of density versus K value for perlite at a mean temperature of 75° F as published by Perlite Institute Inc.

Referring to FIG. 7, a slope of 0.0147 was calculated for the thermal conductivity curve. The measured K value, i.e., 0.276 BTU-in/°F-ft$^2$-hr with the test insulation having a blown density of 3.2 pcf, is approximately on the line shown in FIG. 7 for perlite having a density of 3.2 pcf. Therefore it was assumed that the test insulations of the present invention would have a thermal conductivity curve comparable to that for perlite. Using the algebraic equation $y = mx + b$ where m is the slope of the thermal conductivity (assumed to be the same as that in FIG. 7, i.e., 0.0147) and b is the y-axis (K factor) intercept, estimated K values for the other test thermal insulations of the present invention were obtained.

Other tests were run wherein the thermal insulation was auger fed into sample sidewall cavities having the same dimensions as those described above. In some of the following examples ground cellulose was used as the fibrous material component. Various percentages of the ground cellulose were mixed with various grades of expanded perlite granules. Several types of dust suppressants in varying quantities were also tested.

The results of these tests are summarized in the following Table III:

TABLE III

| Expanded Perlite | Fiber Material | Dust Suppressant | Poured Density | K (BTU-in/° F-ft$^2$-hr) | Observed Results |
|---|---|---|---|---|---|
| 90% PA230* | 10% Ground Cellulose | 5% Glycerine | 6.4 pcf | .366 | |
| 80% PA116** | 20% Ground Cellulose | .35% Glycerine | 3.9 pcf | .303 | |
| 100% PA130*** | | 5% #10 wt Lubricating Oil | | .334 | No apparent dust |
| 95% PA130 | 5% Ground Cellulose | 5% #10 wt Lubricating Oil | | | No apparent dust |

TABLE III-continued

| Expanded Perlite | Fiber Material | Dust Suppressant | Poured Density | K (BTU-in/° F-ft$^2$-hr) | Observed Results |
|---|---|---|---|---|---|
| 90% PA130 | 5% Ground Cellulose | 2½% Glycol<br>2½% water | | | No apparent dust |
| 95% PA130 | 5% Ground Cellulose | 2½% sodium silicate<br>2½% water | | | Some Solidificaton problem in storage |
| 95% PA130 | 5% Ground Cellulose | 5% { ⅓ glycol, ⅓ bentonite clay, ⅓ water } | | | Some solidification problem in storage |
| 80% PA116 | 20% Ground Cellulose | 5% #10 wt<br>Lubricating Oil | | | No apparent dust |
| 90% PA116 | 10% Ground Cellulose | 5% { ½ glycerine, ½ water } | | | No apparent dust |

*PA230 - a grade of expanded perlite marketed by Johns-Manville having a loose density of approximately 7.9 pcf and particle sizes as follows:

| U.S. Sieve No. | % Retained (non-cumulative range) |
|---|---|
| 16 | 4 maximum |
| −16+20 | 8–30 |
| −20+30 | 30–50 |
| −30+50 | 25–55 |
| −50+100 | 3 maximum |

**PA116 - a grade of expanded perlite marketed by Johns-Manville having a poured density of 2.5 pcf and particle sizes within the ranges listed in Table I

***PA130 - a grade of expanded perlite marketed by Johns-Manville having a poured density of approximately 6–7 pcf and particle sizes within the following ranges:

| U.S. Sieve No. | % Retained (non-comulative) |
|---|---|
| +30 | 0–5 |
| −30+50 | 57–67 |
| +50+100 | 28–38 |
| −100 | 0–3 |

TABLE III

| Expanded Perlite | Fiber Material | Dust Suppressant | Poured Density | K (BTU-in/° F-ft$^2$-hr) | Observed Results |
|---|---|---|---|---|---|
| 90% PA230* | 10% Ground Cellulose | 5% Glycerine | 6.4 pcf | .366 | |
| 80% PA116** | 20% Ground Cellulose | .35% Glycerine | 3.9 pcf | .303 | |
| 100% PA130*** | | 5% #10 wt<br>Lubricating Oil | | .334 | No apparent dust |
| 95% PA130 | 5% Ground Cellulose | 5% #10 wt<br>Lubricating Oil | | | No apparent dust |
| 90% PA130 | 5% Ground Cellulose | 2½% Glycol<br>2½% water | | | No apparent dust |
| 95% PA130 | 5% Ground Cellulose | 2½% sodium silicate<br>2½% water | | | Some Solidificaton problem in storage |
| 95% PA130 | 5% Ground Cellulose | 5% { ⅓ glycol, ⅓ bentonite clay, ⅓ water } | | | Some solidification problem in storage |
| 80% PA116 | 20% Ground Cellulose | 5% #10 wt<br>Lubricating Oil | | | No apparent dust |
| 90% PA116 | 10% Ground Cellulose | 5% { ½ glycerine, ½ water } | | | No apparent dust |

*PA230 - a grade of expanded perlite marketed by Johns-Manville having a loose density of approximately 7.9 pcf and particle sizes as follows:

| U.S. Sieve No. | % Retained (non-cumulative range) |
|---|---|
| 16 | 4 maximum |
| −16+20 | 8–30 |
| −20+30 | 30–50 |
| −30+50 | 25–55 |
| −50+100 | 3 maximum |

**PA116 - a grade of expanded perlite marketed by Johns-Manville having a poured density of 2.5 pcf and particle sizes within the ranges listed in Table I

***PA130 - a grade of expanded perlite marketed by Johns-Manville having a poured density of approximately 6–7 pcf and particle sizes within the following ranges:

| U.S. Sieve No. | % Retained (non-comulative) |
|---|---|
| +30 | 0–5 |
| −30+50 | 57–67 |
| +50+100 | 28–38 |
| −100 | 0–3 |

Whereas the present invention has been described in particular relation to the above examples, it should be understood that other and further modifications, apart from those disclosed or suggested herein, may be made within the spirit and scope of the invention.

What is claimed is:

1. A dry free flowing thermal insulation suitable for installation by auger feeding, pouring, blowing or other similar means comprising a dry, free flowing mixture comprising a major amount of granular thermal insulating material mixed with a minor amount of fibrous thermal insulating material.

2. A free flowing thermal insulation according to claim 1 wherein said fibrous material is present in an amount of approximately 5 to 30 weight percent.

3. A free flowing thermal insulation according to claim 2 wherein said fibrous material is present in an amount of approximately 10 to 30 weight percent.

4. A free flowing thermal insulation according to claim 1 further comprising dust suppressant in an amount of 0.5 to 15 weight percent of said insulation.

5. A free flowing thermal insulation according to claim 4 wherein said dust suppressant is present in amount of approximately 2.5 to 10 weight percent.

6. A free flowing thermal insulation according to claim 5 wherein said dust suppressant is selected from the group consisting of ethylene glycol, glycerine or glycerol; water; sodium silicate; oil; lignon sulfonate; and polyethylene glycerine or glycol.

7. A free flowing thermal insulation according to claim 1 wherein said granular material is selected from the group consisting of expanded perlite, vermiculite, pumice, silica, polystyrene or mixtures thereof.

8. A free flowing thermal insulation according to claim 1 wherein said fibrous material is selected from the group consisting of glass fibers, rock wool, slag wool, refractory fibers, asbestos fibers and cellulose fibers, or combinations thereof.

9. A free flowing thermal insulation according to claim 8 wherein said fibrous material comprises discrete nodules of fiber bundles, said nodules having a representative diameter within the range of 0.125 to 1.25 inches.

10. A dry free flowing thermal insulation suitable for installation by auger feeding, pouring, blowing or other similar means comprising a dry, free flowing mixture comprising approximately 10 to 20 weight percent glass fiber blowing wool nodules having a respresentative diameter of approximately 0.25 inches, 80 to 90 weight percent expanded perlite granules having a loose density of 2.5 to 3.0 pcf, and approximately 5 to 10 weight percent of the weight of the glass fiber and perlite of ethylene glycol.

11. In a method of insulating an area by distributing a dry free flowing thermal insulation by auger feeding, pouring, blowing or other similar means into a cavity adjacent the area to be insulated, the improvemennt comprising:

(a) mixing a major amount of a granular thermal insulating material with a minor amount of a fibrous thermal insulating material, and (b) distributing said resulting thermal insulation into said cavity.

12. In a method according to claim 11 wherein said cavity is a space defined by vertically extending studs and inner and outer wall structures of a building.

13. In a method according to claim 11 wherein said cavity is an attic.

14. In a method according to claim 12 wherein said cavity is filled by way of an access hole in one of the wall structures.

15. In a method according to claim 14 wherein said access hole is located near a top portion of said wall structure.

16. In a method according to claim 14 wherein said access hole is located approximately midway along the length of the wall structure.

17. In a method according to claim 11 wherein said granular material is present in an amount of approximately 70 to 95 weight percent.

18. In a method according to claim 17 wherein said granular material is selected from the group consisting of expanded perlite, vermiculite, pumice, silica, polystyrene, or mixtures thereof.

19. In a method according to claim 18 wherein said granular material is expanded perlite having a poured density within the range of 2.5 to 3.0 pcf.

20. In a method according to claim 11 wherein said fibrous material is present in an amount of approximately 5 to 30 weight percent.

21. In a method according to claim 20 wherein said fibrous material is selected from the group consisting of glass fibers, rock wool, slag wool, refractory fibers, asbestos fibers, cellulose or mixture thereof.

22. In a method according to claim 21 wherein said fibrous material is glass fiber nodules having a representative diameter of 0.25 inch.

23. In a method according to claim 11 wherein said insulation comprises 70 weight percent expanded perlite granules having a poured density within the range of 2.5 to 3.0 pcf, 30 weight percent glass fiber nodules having a representative diameter of 0.25 inch, and wherein ethylene glycol is added as a dust suppressant in an amount of approximately 5 weight percent of the insulation.

24. In a method according to claim 11 wherein said insulation comprises 85 weight percent expanded perlite granules having a poured density within the range of 2.5 to 3.0 pcf, 15 weight percent glass fiber nodules having a representative diameter of 0.25 inch, and wherein ethylene glycol is added as a dust suppressant in an amount of approximately 5 weight percent of the insulation.

25. In a method according to claim 11 wherein said insulation comprises 90 weight percent expanded perlite granules having a poured density within the range of 2.5 to 3.0 pcf, 10 weight percent glass fiber nodules having a representative diameter of 0.25 inch, and wherein ethylene glycol is added as a dust suppressant in an amount of approximately 5 weight percent of the insulation.

26. In a method according to claim 11 wherein said insulation comprises 80 weight percent expanded perlite granules having a poured density within the range of 2.5 to 3.0 pcf, 20 weight percent glass fiber nodules having a representative diameter of 0.25 inch, and wherein ethylene glycol is added as a dust suppressant in an amount of approximately 5 weight percent of the insulation.

27. In a method according to claim 11 wherein said insulation comprises 80 weight precent expanded perlite granules having a poured density within the range of 2.5 to 3.0 pcf, 20 weight percent glass fiber nodules having a representative diameter of 0.25 inch, and wherein ethylene glycol is added as a dust suppressant in an amount of approximately 10 weight percent of the insulation.

28. A sidewall cavity defined by inner and outer wall structures and two sequential vertical studs provided with thermal insulation said thermal insulation comprising a dry free flowing thermal insulation suitable for installation by auger feeding, pouring or blowing or other similar means and having a major amount of granular thermal insulating material mixed with a minor amount of fibrous thermal insulating material.

29. A sidewall cavity according to claim 28 wherein said thermal insulation comprises 5 to 30 weight percent fibrous material and 70 to 90 weight percent granular material.

30. A sidewall cavity according to claim 29 further comprising dust suppressant in an amount of 0.5 to 15 weight percent of said thermal insulation.

31. A sidewall cavity according to claim 30 wherein said insulation comprises 5 to 70 weight percent glass fiber nodules having a representative diameter within the range of 0.125 to 1.25 inches, 30 to 95 weight percent expanded perlite granules, and approximately 0.5 to 10 weight percent of said insulation of a dust suppressant.

* * * * *

UNITED STATES PATENT AND TRADEMARK OFFICE

CERTIFICATE OF CORRECTION

PATENT NO. : 4,134,242

DATED : January 16, 1979

INVENTOR(S) : Andrew Musz et al

It is certified that error appears in the above-identified patent and that said Letters Patent are hereby corrected as shown below:

Column 3, line 35, following "thermal" insert --insulation--.

Column 3, line 44, following "insulation" insert --the thermal insulation--.

Column 3, line 49, "desire" should read --desired--.

Column 4, line 14, "BUT" should read --BTU--.

Column 4, line 51, "than" should read --that--.

Column 4, line 63, following "16." insert --Upon adding a granular material,--.

Column 5, line 35, "puring" should read --pouring--.

Column 6, line 49, "45" should read --46--.

UNITED STATES PATENT AND TRADEMARK OFFICE

CERTIFICATE OF CORRECTION

PATENT NO. : 4,134,242

DATED : January 16, 1979

INVENTOR(S) : Andrew Musz et al

It is certified that error appears in the above-identified patent and that said Letters Patent are hereby corrected as shown below:

Columns 9 & 10, under TABLE III - U.S. Sieve No. (second occurrence) "+50 +100" should read -- -50 +100 --.

Columns 9 & 10, TABLE III has been done twice.

Column 11, line 28, Claim 11,"improvemennt" should read --improvement--.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*